United States Patent [19]

Kondo et al.

[11] Patent Number: 4,957,031

[45] Date of Patent: Sep. 18, 1990

[54] AUTOMATIC MUSIC PLAYING APPARATUS HAVING PLURAL TONE GENERATING CHANNELS SEPARATELY ASSIGNABLE TO THE PARTS OF A MUSICAL PIECE

[75] Inventors: Masao Kondo; Yasunao Abe, both of Hamamatsu, Japan

[73] Assignee: Yamaha Corporation, Hamamatsu, Japan

[21] Appl. No.: 293,375

[22] Filed: Jan. 4, 1989

[30] Foreign Application Priority Data

Jan. 6, 1988 [JP] Japan ..... 63-1081

[51] Int. Cl.[5] ..... G10H 1/38; G10H 7/00

[52] U.S. Cl. ..... 84/613; 84/637; 84/DIG. 22

[58] Field of Search ..... 84/1.01, 1.03, 1.28, 84/115, 462, DIG. 12, DIG. 29, 609–614, 634–638, DIG. 22

[56] References Cited

U.S. PATENT DOCUMENTS 3,955,459 5/1976 Mochida et al. ..... 84/115 X
4,344,344 8/1982 Nakada et al. ..... 84/DIG. 12
4,788,896 12/1988 Uchiyama et al. ..... 84/1.01

*Primary Examiner*—Stanley J. Witkowski
*Attorney, Agent, or Firm*—Spensley, Horn, Jubas & Lubitz

[57] ABSTRACT

The present invention provides an automatic music playing apparatus for generating musical tone signals according to music playing information. The apparatus is essentially composed of (a) a tone generating unit having a plurality of tone generating channels for generating musical tone signals in response to tone generation control information; (b) a channel number designation unit for separately designating a desired number of tone generating channels of the tone generating for each part of the musical; and (c) an assignment unit for assigning music playing information to at least one of the tone generating channels.

11 Claims, 11 Drawing Sheets

| TONE PITCH | $C_1$ --- $C_2$ $C_2^{\#}$ --- $B_2$ $C_3$ --- $C_4$ --- $C_5$ |
|---|---|
| KEY CODE | 36 --- 48 49 --- 59 60 --- 72 ---84 |

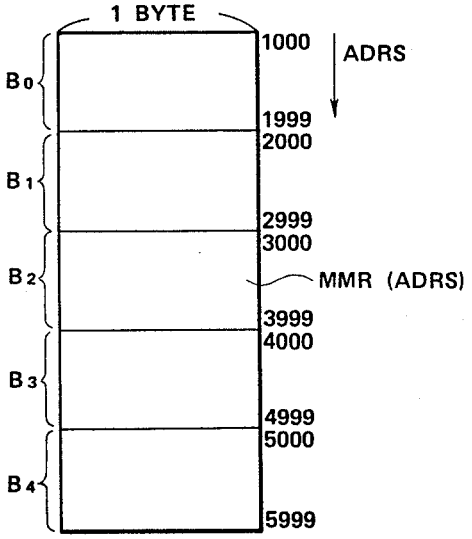
FIG. 3
FIG. 4(A)
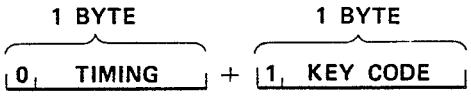
FIG. 4(B)
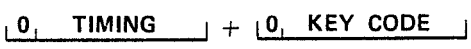
FIG. 4(C)
FIG. 4(D)
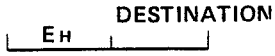
FIG. 4(E)
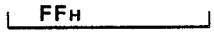

AUTOMATIC MUSIC PLAYING APPARATUS HAVING PLURAL TONE GENERATING CHANNELS SEPARATELY ASSIGNABLE TO THE PARTS OF A MUSICAL PIECE

BACKGROUND OF THE INVENTION

1. Field of the Invention

The present invention relates to an automatic music playing device which incorporates plural tone generating channels, and in particular, relates an improvement in the technology of separate recording and playback of the different parts making up the musical output of such devices.

2. Prior Art

Prior art pertinent to the present invention includes that of automatic music playing devices which can separately record and replay each part of a musical composition, for example, the bass part, the rhythm part, etc., and which are provided with one or more tone generating channels, each individually designated for its respective part. Examples include Japanese Patent Application No. 197095 of 1983. In the case of such devices, the number of available tone generating channels that can simultaneously generate a musical tone are fixed for each part, thereby leading to limitations on the music which may be produced. For example, in a device in which three channels are assigned to the chord part and one channel is assigned to the bass part, it is impossible to generate four tones simultaneously for the chord part or two tones for the bass part.

This problem may be solved by increasing the number of channels available for each part. This, however, requires a more complex design of the tone generation apparatus. Furthermore, it would be costly and inefficient to assign a large number of tone generating channels to a part of the musical output where they might seldom be required.

SUMMARY OF THE INVENTION

The object of the present invention then is to provide for rich and varied automatic music playing through efficient use of a limited number of tone generating channels.

Through implementation of the technology described herein, the object of the present invention is to provide for rich and varied automatic music playing with use of a limited number of tone generating channels. The described device is capable of recording music playing information, including the number of channels designated for each part of the musical output during recording, and during play-back, to perform automatic playing according to the recorded music playing information, employing the individual tone generating channels for each part of the musical output as designated during recording of the music. The automatic music playing apparatus of the invention is provided with a tone generating means, an input means, a mode designation means, a memory means into which data can be written and from which data can be read, a channel number designation means, a channel number recording means, a memory writing means, a part designation means, a memory reading means, and an assignment means.

The tone generating means has N (larger than one) tone generating channels and is designed to generate musical tone signals according to the tone generation control information assigned separately to each tone generating channel.

The input means is designed to input music playing information and may comprise such a component as a keyboard.

The mode designation means is designed to designate either the record mode or the play mode and may comprise such a component as a switch.

The channel number designation means is actuated when the record mode is designated by the mode designation means, and may comprise such components as N switches which are used to designate the desired number of channels within the range N for each part to be recorded.

The channel number recording means is designed to record the number of channels designated for each part by the channel number designation means.

The memory writing means is actuated when the record mode is designated by the mode designation means and is designed to write the music playing information from the input means into the memory means separately for each part.

The part designation means is actuated when the play mode is designated by the mode designation means and is designed to designate the part to be played, which is achieved, for example, by diverting the above mentioned N switches to this purpose.

By the memory reading means, music playing information associated with the part designated by the part designation means is read out from the memory means.

By the assignment means, the music playing information read out from the memory means, which is used as the above-mentioned tone generation control information, is assigned to at least one of the tone generating channels in accordance with the channel number recorded by the channel number recording means in association with the part designated by the part designation means.

The apparatus of the invention can record music playing information including the desired number of channels designated within the range N separately for each part to be recorded, and during replay, perform automatic playing according to the recorded music playing information using the number of channels is designated separately for each part at the time of recording.

If N is 5, for example, one may record chord playing information after designating 3 as the number of channels for the chord part and then record bass playing information after designating 2 as the number of channels for the bass part. Designation of the chord part for replay will permit automatic playing of the chords using three channels while designation of the bass part will permit automatic playing of the bass part using two channels. Designation of both the chord and the bass part will permit simultaneous automatic playing of the chord and the bass part.

Similar recording and replaying can also be performed when 4 and 1 are designated as the number of channels to be used for the chord and the bass part, respectively, or when 5 (all channels) is designated as the number of channels for the chord part.

Thus, the apparatus of the present invention permits varied automatic music playing through efficient use of a limited number of tone generating channels.

FIG. 1 illustrates the structure of an electronic musical instrument which is provided with an automatic music playing apparatus bus on the present invention.

The electronic musical instrument is equipped with a microcomputer to control the generation of tones for manual playing and the recording/replaying (automatic playing) of manually played music.

BRIEF DESCRIPTION OF THE DRAWINGS

FIG. 3 illustrates the structure of the automatic playing memory 22.

FIGS. 4(A)-(E) illustrate the data format for the automatic playing memory 22.

DETAILED DESCRIPTION OF THE PREFERRED EMBODIMENTS OF THE INVENTION

Figures 1, 2:
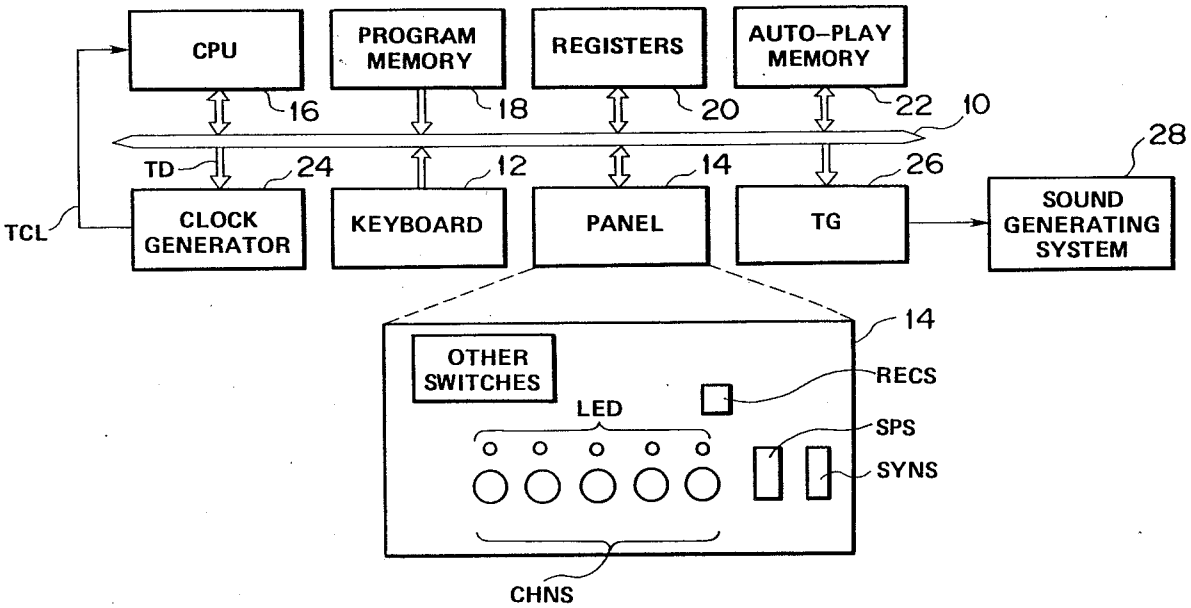
FIG. 1 illustrates a block diagram of an electronic musical instrument provided with an automatic playing apparatus which represents an example of the invention.
FIG. 2 illustrates the key code for each tone pitch.

A block diagram of the present invention is illustrated in FIG. 1. The keyboard 12, panel 14, central processing unit (CPU) 16, program memory 18, register array 20, automatic playing memory 22, clock generator 24, tone generator (TG) 26 and other components are connected with a data bus 10.

The keyboard 12 consists of a number of keys. Each of the keys can detect information concerning the depression and releasing of that key.

The panel 14 contains various display devices including controllers to control musical tones and playing actions. The controllers and display devices implemented in the invention include the five channel number/part designation switches (CHNSs) numbered 10 to 14, display devices for example, light emitting diodes (LEDs) to give red and green light in response to the above-mentioned switches, record mode designation switch (RECS), start/stop switch (SPS), synchronized start switch (SYNS) and many other controllers such as for volume control and tempo control.

The CPU 16 executes processing for various functions including generation of musical tones and recording/replaying of music playing information according to the programs stored in the program memory 18. The execution of these programs is described in detail later with reference to FIGS. 7–14.

The register array 20 contains a variety of registers required for processing by the CPU 16. These registers are described in detail later.

The automatic playing memory 22 stores music playing information and may comprise a random access memory (RAM). The structure and data format of the memory 22 are described later with reference to FIGS. 3 and 4.

The clock generator 24 generates, according to the tempo data (TD), a tempo clock signal (TCL) of a frequency which corresponds to the selected tempo. The clock pulses of the signal (TCL) are used to start the clock interrupt routine shown in FIG. 14.

The TG 26 comprises eight tone generating channels numbered 0 to 7. Channels 0 to 4 can operate independently for automatic playing while channels 5 to 7 can be used only for manual playing. Channels 0 to 4 can also be used for manual playing if not assigned to automatic playing.

The sound system 28 receives musical tone signals from the TG 26 and converts them into audible musical tones. It consists of such components as a amplifier and an speaker.

In the above described electronic musical instrument, a key code is prescribed for each tone pitch as shown in FIG. 2.

Automatic Playing Memory 22 (FIGS. 3 and 4)

FIG. 3 illustrates the structure of the automatic playing memory 22. The memory 22 consists of five memory blocks, designated $B_0$ to $B_4$, which correspond to the channel number/part designation switches (CHNSs) 0–4, respectively. Each of the memory blocks ($B_0$ to $B_4$) consists of 1,000 areas, each of which can store 1 byte (8 bits) of data. The areas in memory blocks $B_0$–$B_4$ have addresses 1000 to 1999, 2000 to 2999, 3000 to 3999, 4000 to 4999 and 5000 to 5999, respectively. In the remainder of this document, a specific memory area or memory data is expressed as MMR(ADRS), where ADRS represents the memory address.

FIG. 4 illustrates the data format for the memory 22. The music playing information stored in memory 22 includes key-on information, key-off information, bar line information, jump information, and finish information, as shown in FIGS. 4(A)–(E).

The key-on information (A) consists of 1 byte of timing information and 1 byte of key code information. The most significant bit (MSB) of the timing data is set to 0 and the remaining seven bits store key-on timing information (count of tempo clock signals (TCLs)). The MSB of the key code data is set to 1 and the remaining seven bits store the key code associated with the key-on event.

The key-off information (B) consists of 1 byte of timing information and 1 byte of key code information. The MSB of the timing data is set to 0 and the remaining seven bits store key-off timing information. The MSB of the key code data is set to 0 and the remaining seven bits store the key code associated with the key-off event.

The bar line information (C) consists of 1 byte of information set to the value 80H(10000000B). Hereafter, H designates hexadecimal notation, B designates binary notation.

The jump information (D) consists of 1-byte of data. The most significant four bits are used as mark bits and are set to EH(11110B). The four least significant bits represent the destination of a jump (any of $B_1$–$B_4$). In some cases, the four least significant bits may be set to FH(1111B) to represent the memory stop location.

The finish information (E) contains 1-byte of information which is set to FFH(11111111B).

Register Array 20

The structure and function of the register array 20 are detailed below.

(1) run flag (RUN): This is two-bit register which has three possible states, 0, 1, or −1, representing the off, on and synchronized start standby state, respectively.

(2) record mode register (REC): This is a five-bit register with bits 0–4 corresponding to switches (CHNSs) 0–4, respectively. If a bit is 1, it indicates that the corresponding switch is in the record mode.

(3) play mode register (PLY): This is a five-bit register and with bits 0–4 corresponding to switches (CHNSs) 0–4, respectively. If a bit is 1, it indicates that the corresponding switch is in the play mode.

(4) clock counter (CLK): This counts the tempo clock signals (TCLs) for each bar. For each bar, the device counts the number of signals up to 95, and is reset to 0 at every 96th signal.

(5) group state registers (GRP(0)–GRP(4): These registers respectively correspond to switches (CHNSs) 0–4. Each register consists of five bits, 0 to 4, which correspond to switches (CHNSs) 0–4, respectively, so as to identify those switches which are in the same group as the switch corresponding to each register. An example of arrangement of the GRPs(0)–(4) is shown below, where switches 0 and 1 are in the same group and switches 2–4 form another group. The leftmost position in each set of data represents the most significant bit (MSB).

| Register | Data |
|---|---|
| GRP (0) | 000011 |
| GRP (1) | 000011 |
| GRP (2) | 111100 |
| GRP (3) | 111100 |
| GRP (4) | 111100 |

(6) key code register (KC): This is a seven-bit register which stores key code information associated with a key on the keyboard 12 where a key event (key-on or key-off event) has taken place.

(7) key code buffer registers (KCBUF(0) to KCBUF(7): These registers respectively correspond to tone generating channels 0–7 in the TG 26. Each register has eight bits: the MSB is 1 or 0 corresponding to a key-on or key-off event while the seven least significant bits store key code information.

(8) read-out key code register (KEKY): This is an eight-bit register to store key code information read out from the automatic playing memory 22. The MSB is 1 or 0 corresponding to a key-on or key-off event respectively, while the seven least significant bits store key code information.

(9) key-on register (KON): This is a one-bit register which stores the same number as the MSB of the register KEY.

(10) address pointer for writing (PNTR): This is used in the record mode in order to write information into the automatic playing memory 22. It can store 16-bit address information. In the record mode, one or more of the memory blocks, $B_0$–$B_4$, are designated by the switches (CHNSs), and the music playing information is written separately for each part. For example, $B_0$ is designated by the switch 0 and bass playing information is written in it. After writing the bass playing information in $B_0$, $B_1$ to $B_4$ are designated by switches 1–4, respectively, and chord playing information is written in them. In this case, $B_1$ to $B_4$ are treated as one continuous memory block. One PNTR suffices since writing is performed part by part as described above.

(11) address pointers for reading out PNTP(0) to PNTP(4): These pointers are used in the play mode in order to read out information from the automatic playing memory 22. They respectively correspond to the memory blocks, $B_0$ to $B_4$. Five pointers are provided to allow the information in each block to be read out separately after information on different parts is written in $B_0$ to $B_4$. Each pointer can store 16-bit address information. In a mode other than the play mode, PNTP(0) to PNTP(4) are all set to 0. If several switches (CHNSs) forming a group are in the play mode, the start of play mode operation allows the pointer corresponding to the switch with the lowest number in the group to represent the top address in the memory block corresponding to that switch. If switches 0–2 form a group, for example, the top address in $B_0$ is set in PNTP(0) while top address setting is not performed for PNTP(1) or PNTP(2), because $B_0$ to $B_2$ are treated as one continuous memory block.

(12) temporary register (TMP): This register temporarily stores the information of the register PLY when the top address is set in PNTP(0)–PNTP(4). Its structure is the same as that of PLY.

(13) assignable channel register (ASS): This register consists of eight bits, 0 to 7, which respectively correspond to tone generating channels 0–7 in the TG 26. If a bit is 0, it indicates that the corresponding channel is assignable.

(14) assigned channel register (CH): This register stores the number of the channel to which key code information is to be actually assigned.

(15) jump destination register (GT): This is a four-bit register which is set to FH (information on memory stop location) or the number (any of 1–4) of the memory block to be used as the destination of a jump.

Figure 7:
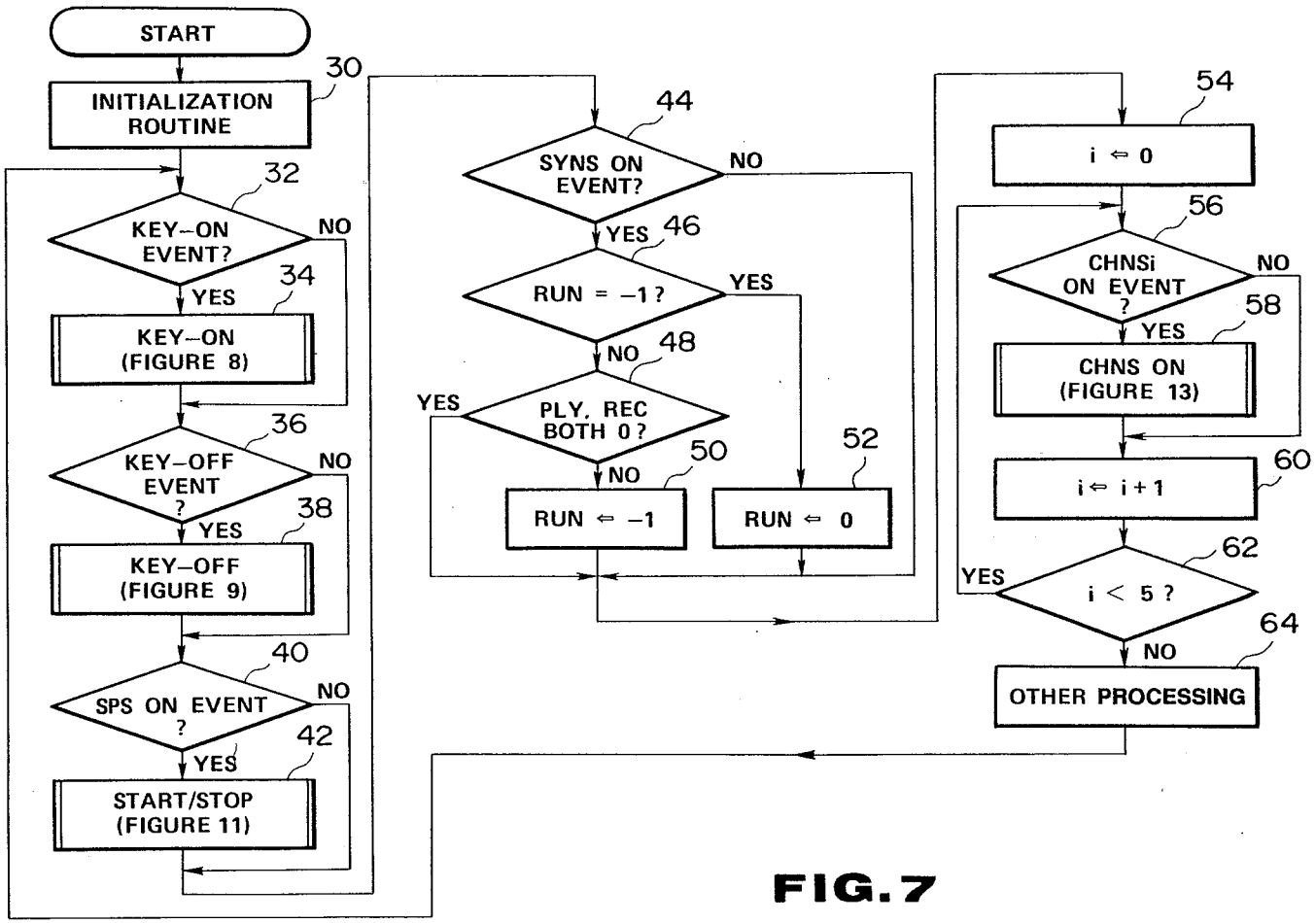
FIG. 7 illustrates a flow chart of the main routine.

Main Routine (FIG. 7)

FIG. 7 illustrates the flow of operations to be executed by the main routine. Execution of the routine is started by turning on the power switch.

In Step 30, the initializing routine is executed to initialize the various registers. For example, 0 is set in RUN, KCBUF(0)–KCBUF(7) and GRP(0)–GRP(4). Then Step 32 is executed.

In Step 32, it is decided whether there is a key-on event on the keyboard 12. If the decision is yes (Y), then the key-on subroutine is executed in Step 36 as described later in detail with reference to FIG. 8.

Execution of Step 36 is directed after the completion of the operation in Step 34 or where the decision in Step 32 is no (N). In Step 36, it is decided whether there is a key-off event on the keyboard 12. If the decision is yes (Y), the key-off subroutine is executed in Step 38 as described later with reference to FIG. 9.

After the completion of the operation in Step 38 or where the decision in Step 36 is no (N), Step 40 is executed to decide whether there is an on event on the start/stop switch 8SPS). If the decision is yes (Y), the start/stop subroutine in Step 42 is then executed as described later with reference to FIG. 11.

After the completion of the operation in Step 42 or where the decision in Step 40 is no (N), Step 44 is executed to decide whether there is an on event on the synchronized start standby switch (SYNS). If the decision is yes (Y), Step 46 is executed to decide whether RUN is −1. If the decision is no (N), it indicates that RUN is either 0 or 1, and Step 48 is executed. In Step 48, it is decided whether both PLY and REC are 0(whether all switches (CHNSs) are in the normal mode). If the decision is no (N), it indicates that they are either in the play mode or the record mode, and Step 50 is then executed. In Step 50, RUN is set to −1 to achieve the synchronized start standby state.

If the decision in Step 46 is yes (Y), Step 52 is then executed to set RUN to 0 to achieve the off state.

Step 54 is executed after the completion of the operation in Step 50 or 52, or where the decision in Step 44 is no (N), or where the decision in Step 48 is yes (Y).

The control variable i is set to 0 in Step 54. Step 56 is then executed to decide whether there is an on event on the i'th channel number/part designation switch (CHNS). If the decision is yes (Y), the CHNS-on subroutine in Step 58 is executed as described later with reference to FIG. 13.

After the completion of the operation in Step 58 or where the decision in Step 56 is no (N), Step 60 is executed to increase the value of i by one, and Step 62 is then executed.

In Step 62, it is decided whether the value of i is smaller than 5, the total number of the switches (CHNSs). Return to Step 56 is directed if the decision is yes (Y). The operations in and after Step 56 are executed repeatedly until the value of i becomes 5. At this point, the execution of the CHNS-on subroutine has been completed for any of the switches from $CHNS_0$ to $CHNS_4$ where there is an on event.

When i reaches 5, the decision in Step 62 becomes no (N) and execution of Step 64 is directed. After other operations (concerning the volume, tempo, etc.) are executed in Step 64, the operations in and after Step 32 are executed again in the same way as above.

Figure 8:
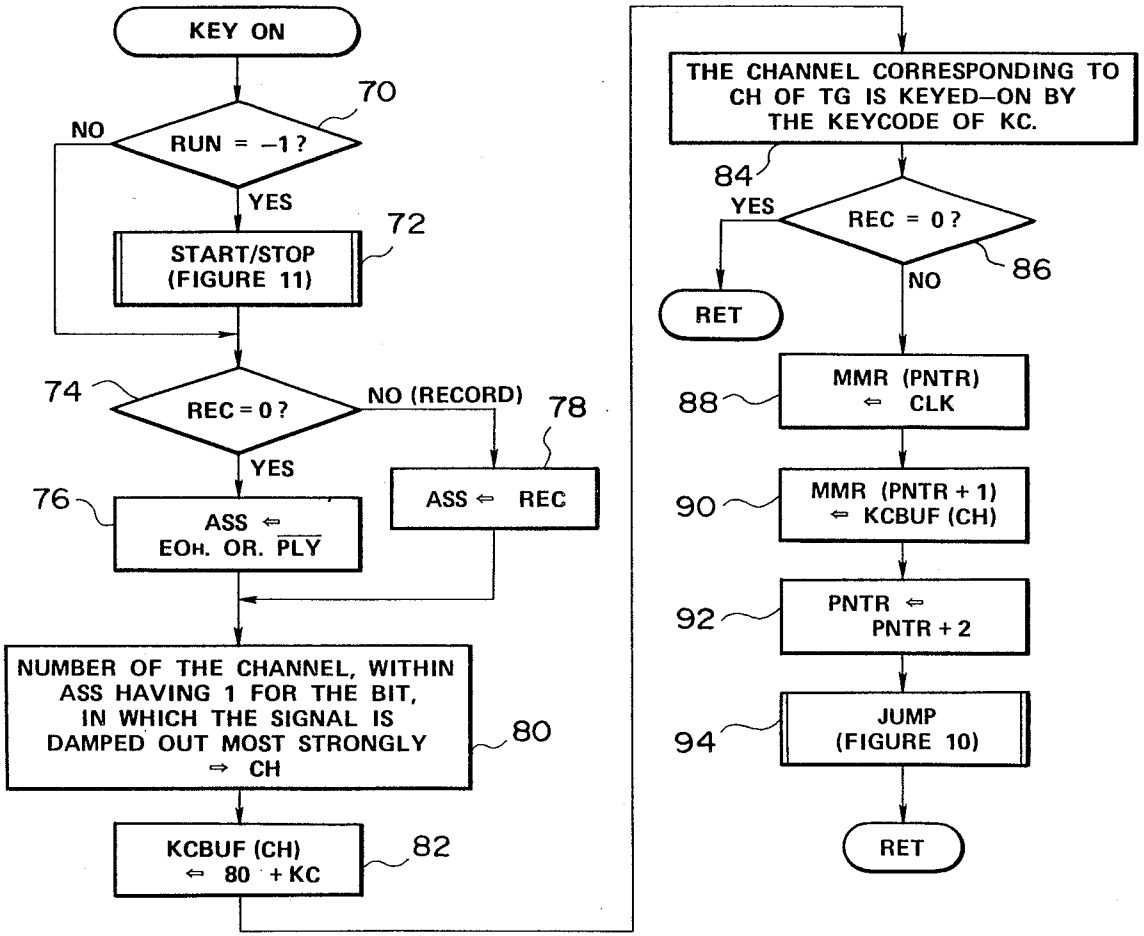
FIG. 8 illustrates a flow chart of the key-on subroutine.

Key-on Subroutine (FIG. 8)

Figure 11:
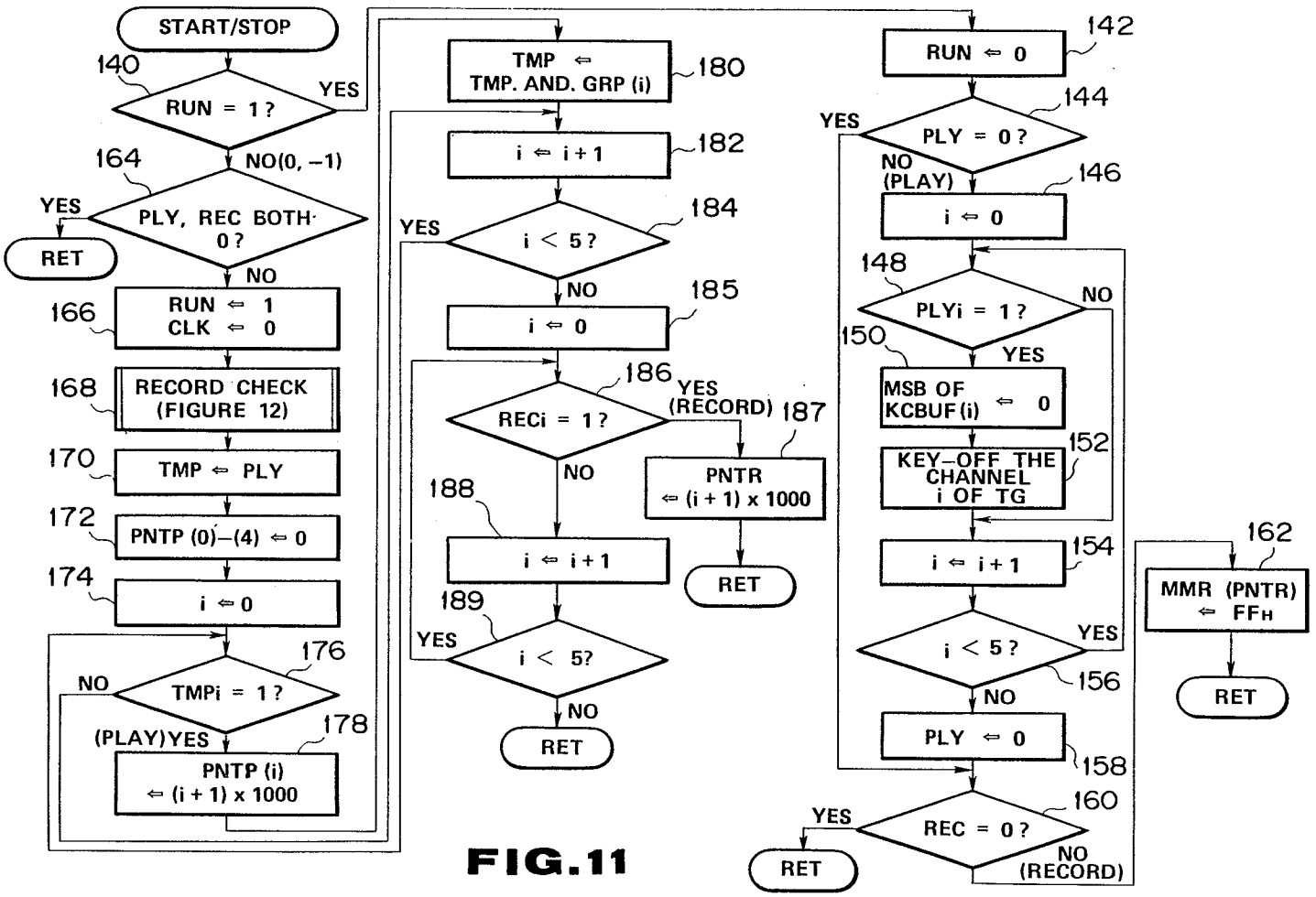
FIG. 11 illustrates a flow chart of the start/stop subroutine.

In the key-on subroutine illustrated in FIG. 8, if RUN is −1(synchronized start standby state) is first decided in Step 70. If the decision is yes (Y), the start/stop subroutine is executed in Step 72 as shown in FIG. 11.

After the completion of the operation in Step 72 or where the decision in Step 70 is no (N), Step 74 is executed to decide whether REC is 0 (normal or play mode). Step 76 is executed if the decision is yes (Y).

In Step 76, OR operation is executed between EOH and PLY, which is obtained by inverting each bit of PLY, and the results are put into ASS. This OR operation is intended for detection of assignable channels. If PLY is 11100, for example, the operation gives 11100011, indicating that the channels 0,1,5–7 are assignable.

If the decision is Step 74 is no (N), it indicates that one of the switches (CHNSs) is in the record mode, and execution of Step 78 is directed. Step 78 is designed to put the contents of REC into ASS. If REC is 00011, for example, the transfer of the data into ASS allows channels 0 and 1 to become assignable.

After the completion of the operation in Step 76 or 78, Step 80 is executed so that the number of the channel with the largest tone volume decrement among the channels corresponding to the bit with 1 in ASS is put into CH. In the case where the bits corresponding to channels 0 and 1 are 1, for example, 0 is set in CH if the tone volume decrement is larger in channel 0.

Next, Step 82 is executed so that the contents of KC plus 80H are put into the register KCBUF(CH) which corresponds to the number of the channel stored in CH. By this addition operation, 1 is added as bit 7 to the key code corresponding to the key with a key-on event in order to form eight-bit information. Transfer of this key-code information into KCBUF(CH) permits the assignment of the key-code information to the channel corresponding to CH. Step 84 is executed after Step 82.

In step 84, the TG's 26 channel corresponding to CH is subjected to key-on operation according to the key code in KC to generate musical tone signals corresponding to that key code. Execution of Step 86 is then directed.

Whether REC is 0 (normal or play mode) is decided in Step 86. Return to the routine shown in FIG. 7 is directed if the decision is yes (Y). RET in the flow charts in and after FIG. 8 represents return.

If the decision in Step 88 is no (N), it indicates that one or more of the switches (CHNSs) is in the record mode, and execution of Step 88 is then directed. In Step 88, the value of CLK (key-on timing information) is written in the memory area MMR(PNTR) in the automatic playing memory (22) with an address represented by PNTR. Execution of Step 90 is then directed.

In Step 90, the key code information of KCBUF(CH) is written in the memory area MMR(PNTR+1), which is next to MMR(PNTR). The value of PNTR is increased by two in Step 92, and execution of Step 94 is then directed.

In Step 94, the jump subroutine is executed as described later with reference to FIG. 10. Return to the routine shown in FIG. 7 is then directed.

Figure 9:
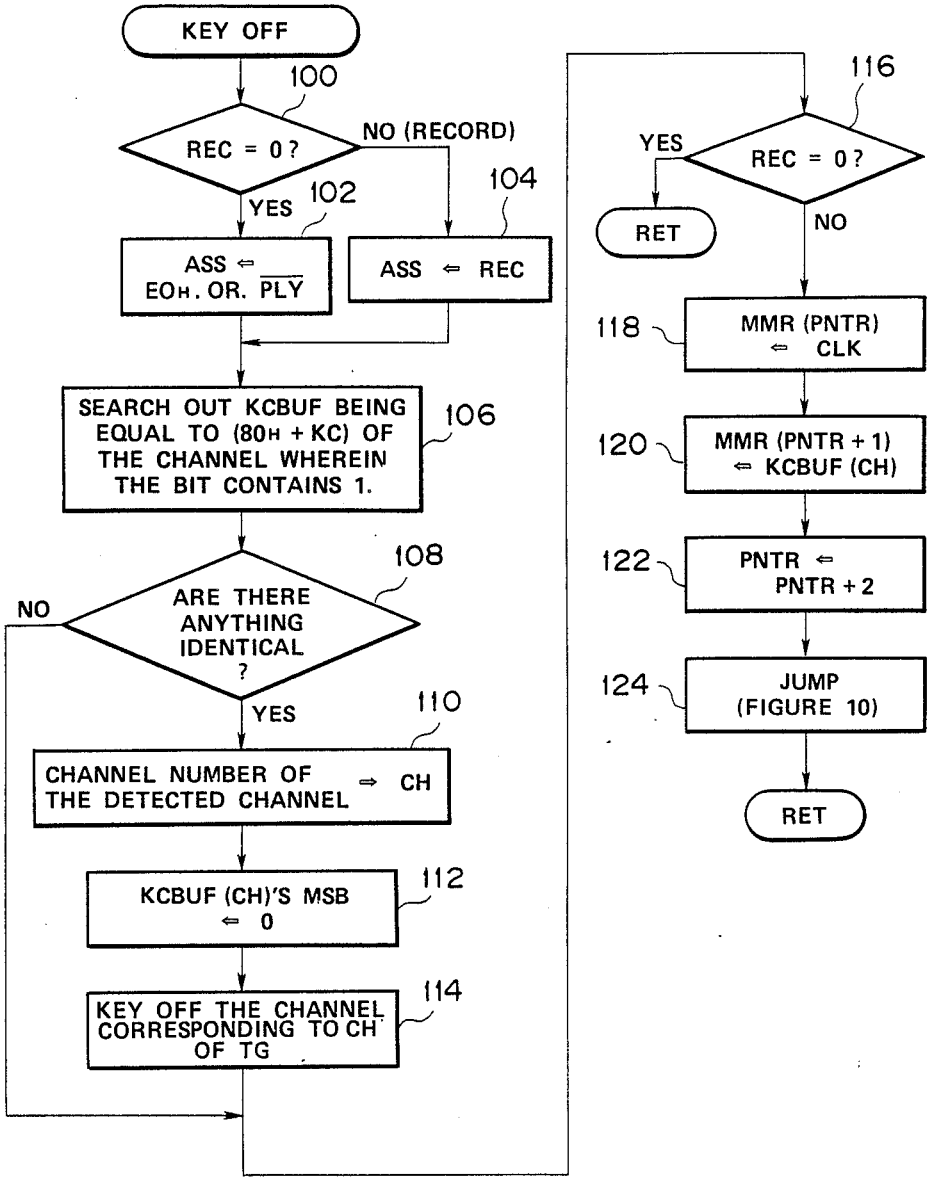
FIG. 9 illustrates a flow chart of the key-off subroutine.

Key-Off Subroutine (FIG. 9)

Steps 100, 102 and 104 in the key-off subroutine shown in FIG. 9 are basically the same as Steps 74, 76 and 78 above, respectively. Thus, whether REC is 0 is decided in Step 100. Step 102 is executed if the decision is yes (Y), or Step 104 is executed if it is no (N). In Step 102, OR operation between EOH and PLY is executed and the results are put into ASS. Step 104 is designed to put the contents of REC into ASS.

Step 106 is executed after Step 102 or 104. In Step 106, all KCBUFs associated with the channels corresponding to the bits with 1 in ASS are examined to search for those which are equivalent to the data of (80H+KC). The data of (89H+KC) consists of 1 added as bit 7, the MSB, to the key code related with a key-off event. The examination of the KCBUFs associated with the assignable channels to search for those equivalent to the above data corresponds to searching for channels which have already been provided with data equivalent to the key-code associated with the key-off event.

Next, whether such equivalent data exist is decided in Step 108. Execution of Step 110 is directed if the decision is yes (Y). In Step 110, the number of the data-assigned channel identified above is put into CH. Execution of Step 112 is then directed.

The MSB of the KCBUF(CH) is set to 0 in Step 112. As a result, the key code information stored in KCBUF(CH) becomes writable as key-off information. Following this, Step 114 is executed so that the TG(26)'s channel which corresponds to CH is subjected to key-off operation to stop the musical tone signals which are being generated.

After the completion of the operation in Step 114 or where the decision in Step 108 is no (N), Step 116 is executed to decide whether REC is 0 as in the case of Step 86. Return to the routine illustrated in FIG. 7 is directed if the decision is yes (Y).

If the decision in Step 116 is no (N), Step 118 is executed to write the value of CLK (key-off timing information) in MMR(PNTR). Execution of Step 120 is then directed.

In Step 120, the key code information stored in KCBUF(CH) is written in MMR(PNTR+1). Then, the value of PNTR is increased by two in Step 122, followed by the execution of Step 124.

Figure 10:
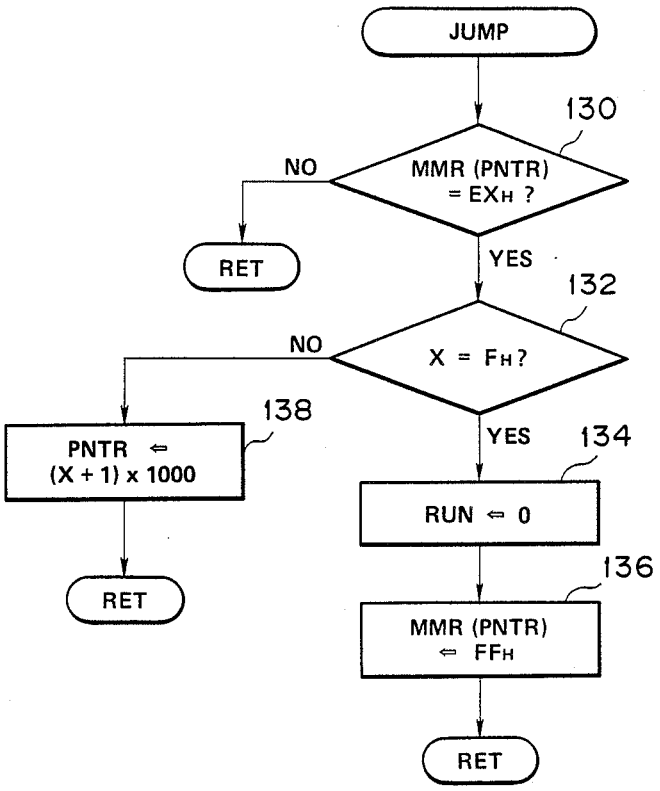
FIG. 10 illustrates a flow chart of the jump subroutine.

In Step 124, the jump subroutine shown in FIG. 10 is executed and return to the routine shown in FIG. 7 is then directed.

Jump Subroutine (FIG. 10)

Step 130 in the jump subroutine shown in FIG. 10 is designed to decide whether the data in MMR(PNTR) is EX H. Here, X represents the four least significant bits, but their values are disregarded. Therefore, the question of whether it is EX H is equivalent to the question of whether it is a jump mark. Return to the original routine is directed if the decision in Step 130 is no (N).

If the decision in Step 130 is yes (Y), Step 132 is executed to decide whether the above-mentioned X (four least significant bits) are FH (memory stop location). If the decision is yes (Y), RUN is set to 0 in Step 134, and FFH (finish information) is written in MMR(PNTR) in Step 136. Then, return to the original routine is directed.

Step 138 is executed if the decision in Step 132 is no (N). In Step 138, the top address in the jump destination is calculated according to the formula $(X+1)\times 1000$, and the result is substituted for PNTR. If $X=1$, for example, 2000 is substituted for PNTR to permit the jump to memory block $B_1$.

Start/Stop Subroutine (FIG. 11)

In the start/stop subroutine illustrated in FIG. 11, whether RUN is 1 (on state) if first decided in Step 140. If the decision is yes (Y), it indicates that the switch (SPS) is in the on state. Thus RUN is set to 0 in Step 142 to achieve the off state, and execution of Step 144 is then directed.

Whether PLY is 0 (normal or record mode) is decided in Step 144. If the decision is no (N), it indicates that one or more of the switches (CHNSs) are in the play mode, and execution of Step 146 is then directed.

The control variable i is set to 0 in Step 146, followed by the execution of Step 148 for decision of whether PLY., the i'th but in PLY, is 1/ If the decision is yes (Y), it indicates that the i'th switch (CHNS) is in the play mode, and execution of Step 150 is then directed.

The MSB in the register KCBUF(i), which corresponds to the i'th channel, is set to 0 in Step 150, followed by Step 152 where key-off operation is executed for the i'th in TG 26).

Next, the value of i is increased by one in Step 154, followed by Step 156 where it is decided whether i is smaller than 5. If the decision is yes, return to Step 148 is directed. The operations in and after Step 148 are repeated in the same way as above until the value of i reaches 5. Thus, all channels in the play mode have been subjected to key-off operation.

When the value of i becomes 5, the decision in Step 156 becomes no (N) and the execution of Step 158 is directed. PLY is set to 0 in Step 158.

After the completion of the operation in Step 158 or whether the decision in Step 144 is yes (Y), Step 160 is executed to decide whether REC is 0 (normal mode). Return to the original routine is directed if the decision is yes (Y).

If the decision in Step 160 is no (N), it indicates that one or more of the switches (CHNSs) are in the record mode, and execution of Step 162 is directed.

In Step 162 FFH (finish information) is written in MMR(PNTR) and return to the original routine is directed.

If the decision in Step 140 is no (N), on the other hand, it indicates that the apparatus is in the off state or synchronized start standby state, and execution of Step 164 is directed. Whether both PLY and REC are 0 (normal mode) is decided in Step 162. Return to the original routine is directed if the decision is yes (Y).

Step 166 is executed if the decision in Step 164 is no (N). In Step 1656, RUN and CLK are set to 1 and 0, respectively, to run the apparatus. Step 168 then follows to execute the record-check subroutine as described later with reference to FIG. 12.

Next, the contents of PLY are put into TMP in Step 170, and PNTP(0)–PNTP(4) are all set to 0 in Step 172. Execution of Step 174 is then directed.

The control variable i is set to 0 in Step 174, and Step 176 is executed to decide whether $TMP_i$, the i'th bit in TMP, is 1. If the decision is yes (Y), it indicates that the i'th switch (CHNS) is in the play mode, and the execution of Step 178 is directed.

In Step 178, the top address is set in the pointer PNTP(i) which corresponds to the i'th memory block. The top address is calculated according to the formula $(i+1)\times 1000$. If i is 0, for example, 1000 is set in PNTP(0) as the top address in the memory block $B_0$. Execution of Step 180 is then directed.

In Step 180, AND operation is executed between the contents of TMS and GRP(i), which is obtained by inverting each bit in GRP(i). The results are put into TMP. The AND operation is required where several switches (CHNSs) form a group, in order to set the top address only in the pointer which corresponds to the switch with the lowest number in the group. Suppose, for example, that TMP is 00011 as a result of switches 0–1 being set to the play mode, and that both GRP (0) and GRP (2) are 00101 as a result of switches 0 and 2 being in the same group. Then, the execution of the AND operation sets 00010 in TMP. In this example, 1000 is set in PNTP(0) when i is 0.

After the completion of the operation in Step 180 or where the decision in Step 176 is no (N), the value of i is increased by one in Step 182, followed by the execution of Step 184.

Whether i is smaller than 5 is decided in Step 184. Return to Step 176 is directed if the decision is yes (Y). The operation in and after Step 176 are executed repeatedly in the same way as above until i reaches 5. In the above example, 00010 is set in TMP for i of 0 in Step 180, and then i is increased to 1 in Step 182, followed by the execution of Step 176 where the decision of yes (Y) is given. Therefore, 2000 is set in PNTP(1) as a result of the execution of Step 178. If all bits of GRP(1) are 0 (indicating that switch 1 does not form a group with other switches), 00011 is set in TMP in Step 180. When, following this, Step 176 is executed after the value i is increased to 2 in Step 182, the decision of no (N) is given in Step 176 and the execution of Step 182 directed. Therefore, the top address setting is not performed for PNTP(2).

The decision of no (N) is given in Step 184 and the execution of Step 185 is directed when i becomes 5. In Step 185, i is set to 0 and the execution of Step 186 is directed.

In Step 186, it is decided whether $REC_i$, the first bit of REC, is 1 (whether the i'th switch (CHNS) is in the record mode). If the decision is yes (Y), Step 187 is executed so that the top address calculated by the formula $(i+1)\times 1000$ is put into PNTR. The address set here will be used as the top address for writing. Return to the original routine is directed after the execution of Step 187. Therefore, if REC indicates several switches (CHNSs) to be set to record mode, the top address setting operation is performed only once in Step 187, i.e. for the switch which has the lowest number.

If the decision in Step 186 is no (N), the execution of 189 is directed after the value of i is increased by one in Step 188. Whether i is smaller than 5 is decided in Step 189. Return to Step 186 is directed if the decision is yes (Y). The operations in and after Step 186 are executed repeatedly in the same way as above until the value of i reaches 5.

When the value of i becomes 5, the decision of no (N) is given in Step 189 and the return to the original routine is directed.

Figure 12:
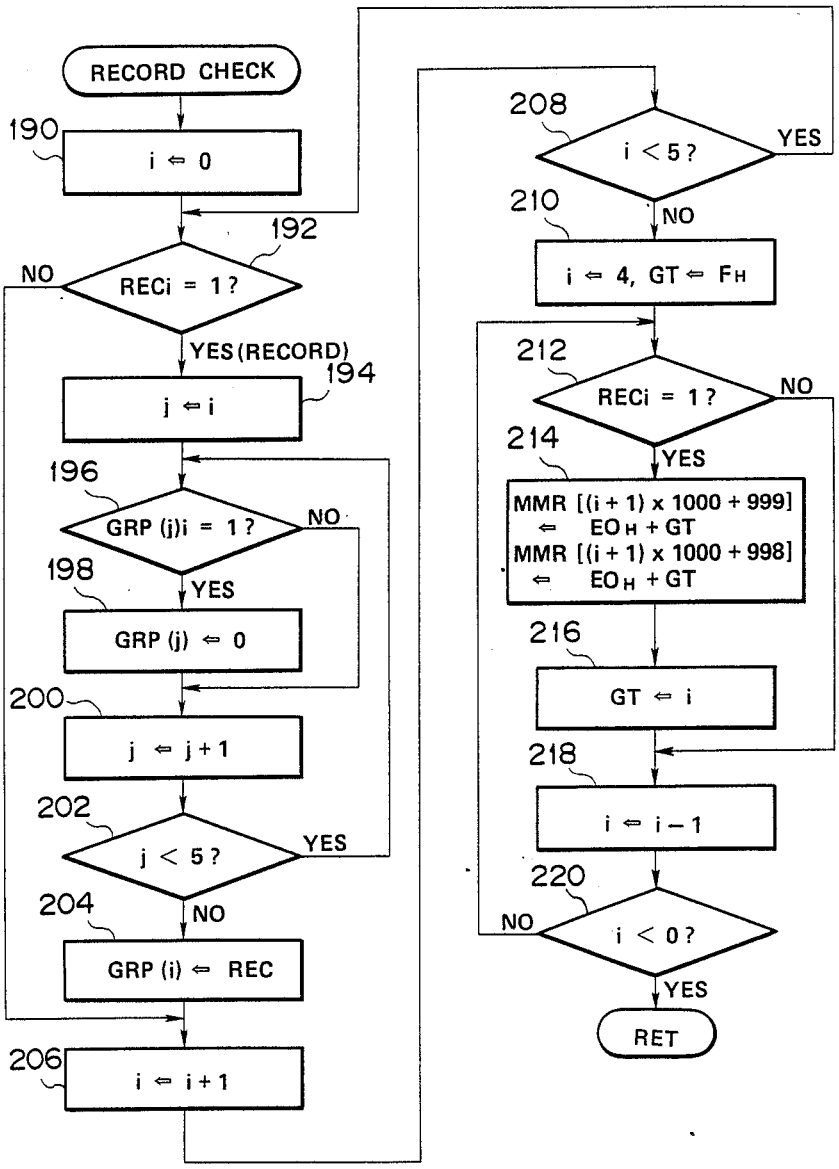
FIG. 12 illustrates a flow chart of the record-check subroutine.

Record-Check Subroutine (FIG. 12)

In the record-check subroutine illustrated in FIG. 12, first the control variable i is adjusted to 0 in Step 190, and execution of Step 192 is then directed.

Whether $REC_i$, the i'th bit in REC, is 1 is decided in Step 192. If the decision is yes (Y), it indicates that one or more of the switches (CHNSs) is in the record mode, and Step 194 is then executed. The control variable j is adjusted to i in Step 194, and execution of Step 196 is directed.

In Step 196, it is decided whether the i'th bit in the register GRP(j), which corresponds to the j'th switch (CHNS), is 1. If the decision is yes (Y), Step 198 is executed to set 0 in GRP(j).

After the completion of the execution of Step 198 or where the decision in Step 196 is no (N), the value of j is increased by one in Step 200, and whether j is smaller than 5 is decided in Step 202. Return to Step 196 is directed if the decision is yes (Y). The operations in and after Step 196 are executed repeatedly in the same way as above until the value of j reaches 5.

When the value of j becomes 5, the decision of no (N) is given in Step 202 and the execution of Step 204 is directed. In Step 204, the contents of REC are put into the register GRP(i) which corresponds to the i'th switch (CHNS).

After the completion of the execution of Step 204 or where the decision in Step 192 is no (N), the value of i is increased by one in Step 206, and whether i is smaller than 5 is decided in Step 208. Return to Step 192 is directed if the decision is yes (Y). The operations in and after Step 192 are executed repeatedly in the same way as above until the value of j reaches 5.

When the value of i becomes 5, the decision of no(N) is given in Step 208 and the execution of Step 210 is directed. All these operations are designed to form new groups after canceling the groups formed previously.

Suppose, for example, GRP(0) and GRP(2) are both 00101 as a result of switches (CHNSs) 0 and 2 being in the same group, and that REC is 00011 as a result of switches 0 and 1 being in the record mode. If Step 192 is executed for i of 0, $REC_0$ is 1 and the decision of yes (Y) is given. The decision of yes (Y) is also given in Step 196 because $GRP(0)_0$ is 1. Therefore, 0 is set in GRP(0) in Step 198. When Step 196 is later executed for j of 2, the decision of yes (Y) is given because $GRP(2)_0$ is 1, followed by Step 198 where 0 is set in GRP(2). Thus, the group of switches (CHNSs) 0 and 2 is canceled.

When the value of j later becomes 5, the data of REC, i.e. 00011, is set in GRP(0) in Step 204. When Step 192 is executed for i of 1, the decision of yes (Y) is given because $REC_1$ is 1, followed by Step 194 where the value of j is set to 1. The decision of no (N) in given is Step 196 when $GRP(1)_1$ is 0, followed by return to Step 196 after setting j to 2. The decision of no (N) is given in Step 196 because $GRP(2)_1$ has already been set to 0.

When the value of j later becomes 5, the data in REC, i.e. 00011, is set in GRP(1) in Step 204. Step 208 is followed by Step 210 when the value of i becomes 5. Consequently, the group of switches (CHNSs) 1 and 2 is canceled and the group of switches (CHNSs) 0 and 1 is newly formed.

The operations in and after Step 210 are intended to write the jump destination and memory stop location into memory areas (MMR) in the automatic playing memory 22 in order to allow the apparatus to run in the record mode.

In Step 210, the value of i is adjusted to 4 and $F_H$ (information on memory stop location) is put into GT. Step 212 is then executed to decide whether $REC_i$ is 1 in the same way as in Step 192 above. Execution of Step 214 is directed if the decision is yes (Y).

In Step 214, the data of EOH plus GT is written into two memory areas (two last areas in the memory black), i.e. MMR $((i+1)\times 1000+999)$ and MMR $((i+1)1000+999)$. Then the value of i is put into GT in Step 216.

After the completion of the execution of Step 216 or the decision of no (N) is given in Step 212, Step 218 is executed to decrease the value of i by one, followed by the execution of Step 220 to decide whether the value of is smaller than 0, return to Step 212 is directed if the decision is no (N), and the operations in and after Step 212 are executed repeatedly in the same way as above until the value of i becomes −1.

When the value of i reaches −1, the decision of yes (Y) is given in Step 220 and return to the routine illustrated in FIG. 11 is directed.

If REC is 00011 as in the above example, the decision of no (N) is given in Step 212 for i of 4 because $REC_4$ is 0, and then the execution of Step 218 is directed. After the value of i is adjusted to 3 in Step 218, the decision of no (N) is given again in Step 212. The same decision is also given when i is 2.

When Step 212 is executed after i is adjusted to 0 in Step 218, the decision of yes (Y) is given because $REC_1$ is 1. Thus, the data of EOH plus FH is written into both MMR(2999) and MMR(2998). Then, 1 is put into GT in Step 216 and the value of i is adjusted to 0 in Step 218.

When Step 212 is later executed for i of 0, the decision of yes (Y) is given because $REC_0$ is 1. Then, the data of EOH plus 1 (which directs a jump to the memory block $B_1$) is written in MMR(1999) and MMR(1998) in Step 214, followed by Step 218 where the value of i is set to −1. In Step 220, therefore, the decision of yes (Y) is given and the return to the routine shown in FIG. 11 is directed. Thus, the memory blocks $B_0$ and $B_1$ are combined into virtually one continuous block.

Figure 13:
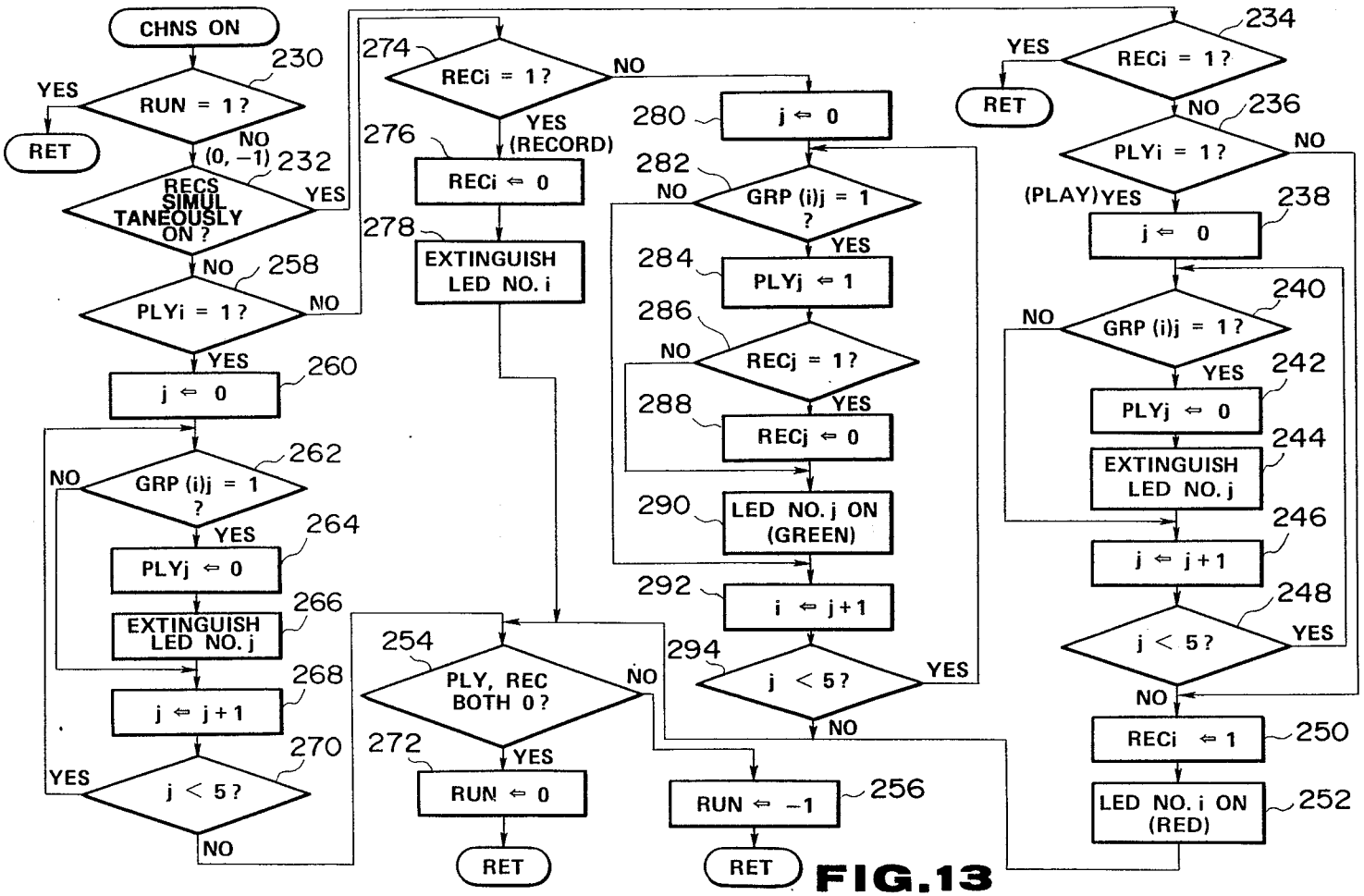
FIG. 13 illustrates a flow chart of the channel number/part designation switch (CHNS)-on subroutine.

SHNS-On Subroutine (FIG. 13)

In the CHNS-on subroutine illustrated in FIG. 13, whether RUN is 1 is first decided in Step 230. Return to the routine shown in FIG. 7 is directed if the decision is yes (Y). This indicates that the following operations will not be executed if the apparatus is in the on state.

If the decision in Step 230 is no (N), it indicates that RUN is either 0 or −1, and the execution of Step 232 is directed. Step 232 is designed to decide whether the record mode designation switch (RECS) is to be simultaneously turned on. Execution of Step 234 is directed if the decision is yes (Y).

Whether $REC_i$, the i'th bit in REC, is 1 (i.e. whether the i'th switch (CHNS) operated is in the record mode) is decided in Step 234, and the return to the routine shown in FIG. 7 is directed if the decision is yes (Y). This indicates that the following operations are not necessary because the switch is already in the record mode.

If the decision in Step 234 is no (N), Step 236 is executed to decide whether $PLY_1$, the i'th bit in PLY, is 1 (i.e. whether the i'th switch (CHNS) operated is in the play mode). If the decision is yes (Y), Step 238 is executed to set the control variable j to 0, followed by the execution of step 240.

Step 240 is designed to decide whether $GRP(i)_j$, the j'th bit in GRP(i) which corresponds to the i'th switch (CHNS) operated, is 1. If the decision is yes (Y), Step 242 is executed to set 0 in $PLY_j$, the j'th bit in PLY. Then, Step 244 is executed to turn off the No.j LED which corresponds to $PLY_j$. Thus, the j'th switch (CHNS), which is in the same group as the i'th switch (CHNS) operated, is now in the normal mode.

After the completion of the execution of Step 244 or where the decision in Step 240 is no (N), Step 246 is executed to increase the value of j by one and then Step 248 is executed to decide whether the value of j is smaller than 5. Return to Step 240 is directed if the decision is yes (Y). The operation in and after Step 240 are executed repeatedly in the same way as above until the value of j becomes 5. Thus, the switches (CHNS) which were in the same group as the i'th switch (CHNS) are now in the normal mode.

When the value of j reaches 5, the decision of no is given in Step 248 and the execution of Step 250 is directed. If the decision in Step 236 is no (N), it indicates that the i'th switch (CHNS) is in the normal mode, and the execution of Step 250 is directed.

Step 250 is designed to set 1 in $REC_i$, and direct the execution of Step 252 so that LED i, which corresponds to the i'th switch (CHNS) operated, gives red light. Thus, the i'th switch (CHNS) is now in the record mode. Step 254 is then executed.

Step 254 is designed to decide whether PLY and REC are both 0. When $REC_i$ is set to 1 in Step 250 as in the above example, the decision of no (N) is given in Step 254 and the execution of Step 256 is directed.

In Step 256, −1 is put into RUN to achieve the synchronized start standby state. Then, return to the routine shown in FIG. 7 is directed.

If the decision in Step 232 is no (N), it indicates that only the i'th switch (CHNS) is operated, and execution of Step 258 is then directed. In Step 258, whether $PLY_i$ is 1 is decided as in Step 236 above. If the decision is yes (Y), it indicates that the i'th switch (CHNS) operated is in the play mode, and the execution of Step 260 is directed.

The value of j is set to 0 in Step 260. Step 240 is then executed to whether decide $GRP(i)_j$ is 1 as in Step 240 above. If the decision is yes (Y), Step 264 is executed to set $PLY_j$ to 0 as in Step 242. Step 266 is then executed to turn on LED j which corresponds to $PLY_j$.

After the completion of the execution of Step 266 or where the decision in Step 262 is no (N), Step 268 is executed to increase the value of j by one and Step 270 is executed to decide whether j is smaller than 5. Return to Step 262 is directed if the decision is yes (Y), and the operations in and after Step 262 are executed repeatedly in the same way as above until j becomes 5.

When j becomes 5, the decision of no (N) is given in Step 270, and the execution of Step 254 is directed. Thus, the i'th switch (CHNS) operated and the switches in the same group are now in the normal mode.

Whether PLY and REC are both 0 is decided in Step 254, and if the decision is no (N), the execution of Step 256 and the return to the routine shown in FIG. 7 are directed as in the above case. If the decision in Step 254 is no (N), it indicates that switches (CHNSs) 0–4 are all in the normal mode, and the execution of Step 272 is directed.

If the decision in Step 258 is no (N), whether $REC_i$ is 1 is decided in Step 274 in the same way as in Step 234 above. If the decision is yes (Y), it indicates that the i'th switch (CHNS) operated is in the record mode, and the execution of Step 276 is directed.

$REC_i$ is set to 0 in Step 276. Step 278 is then executed to turn off the No.i LED which corresponds to $REC_i$. Thus, the i'th switch (CHNS) is now in the normal mode. Then, return to Step 254 is directed, and the operations in and after it are executed in the same way as above.

If the decision in Step 274 is no (N), it indicates that the i'th switch (CHNS) is in the normal mode, and the execution of Step 280 is directed.

j is set to 0 in Step 280, and whether $GRP(i)_j$ is 1 is decided in Step 282 as in the case of Step 240 above. If the decision is yes (Y), Step 284 is executed to set 1 in $PLY_j$ Execution of Step 286 is then directed.

Whether $REC_j$, the j'th bit in REC, is 1 is decided in Step 286. If the decision is yes (Y), $REC_j$ is set to 0 in Step 288 to turn off the j'th switch (CHNS) from the record mode.

After the completion of the execution of Step 288 or where the decision in Step 286 is no (N), Step 290 is executed to cause the j'th LED, which corresponds to $REC_j$, to give green light. Thus, the j'th switch (CHNS) is now in the play mode.

After the completion of the execution of Step 290 or where the decision in Step 282 is no (N), Step 290 is executed to increase the value of j by one and Step 294 is executed to decide whether j is smaller than 5. If the decision is yes (Y), return to Step 282 is directed and the operations in and after Step 282 are executed repeatedly in the same way as above until j becomes 5.

When j becomes 5, the decision of no (N) is given in Step 294, and the execution of Step 254 is directed. Then, the operations in and after Step 254 are executed in the same way as above.

By the operations in Steps 280–294, the i'th switch (CHNS) operated is shifted from the normal mode to the play mode. Furthermore, of the other switches in the same group as the above one, those in the normal mode are shifted to the play mode while those in the record mode are shifted from the record mode to the play mode. Suppose, for example, GRP(0) to GRP(2)

are all 00111 as a result of switches (CHNSs) 0–2 being in the same group. If switches 0–2 are all in the normal mode, turning on switch (CHNS) 0 will cause the operations in Steps 282, 284 and 290 to be executed three times, i.e. for j of 0 to 2. As a result, PLY is set to 000111 and LEDs 0–2 give green light. Thus, not only switch 0 but also switches 0 and 2 are now in the play mode. If, in this case, REC is 00110 as a result of switches 1 and 2 being in the record mode, the operations in Steps 286 and 288 are executed for j of 1 and 2 to set all bits in REC to 0. Thus, switches 1 and 2 are shifted from the record mode to the play mode.

Figure 14:
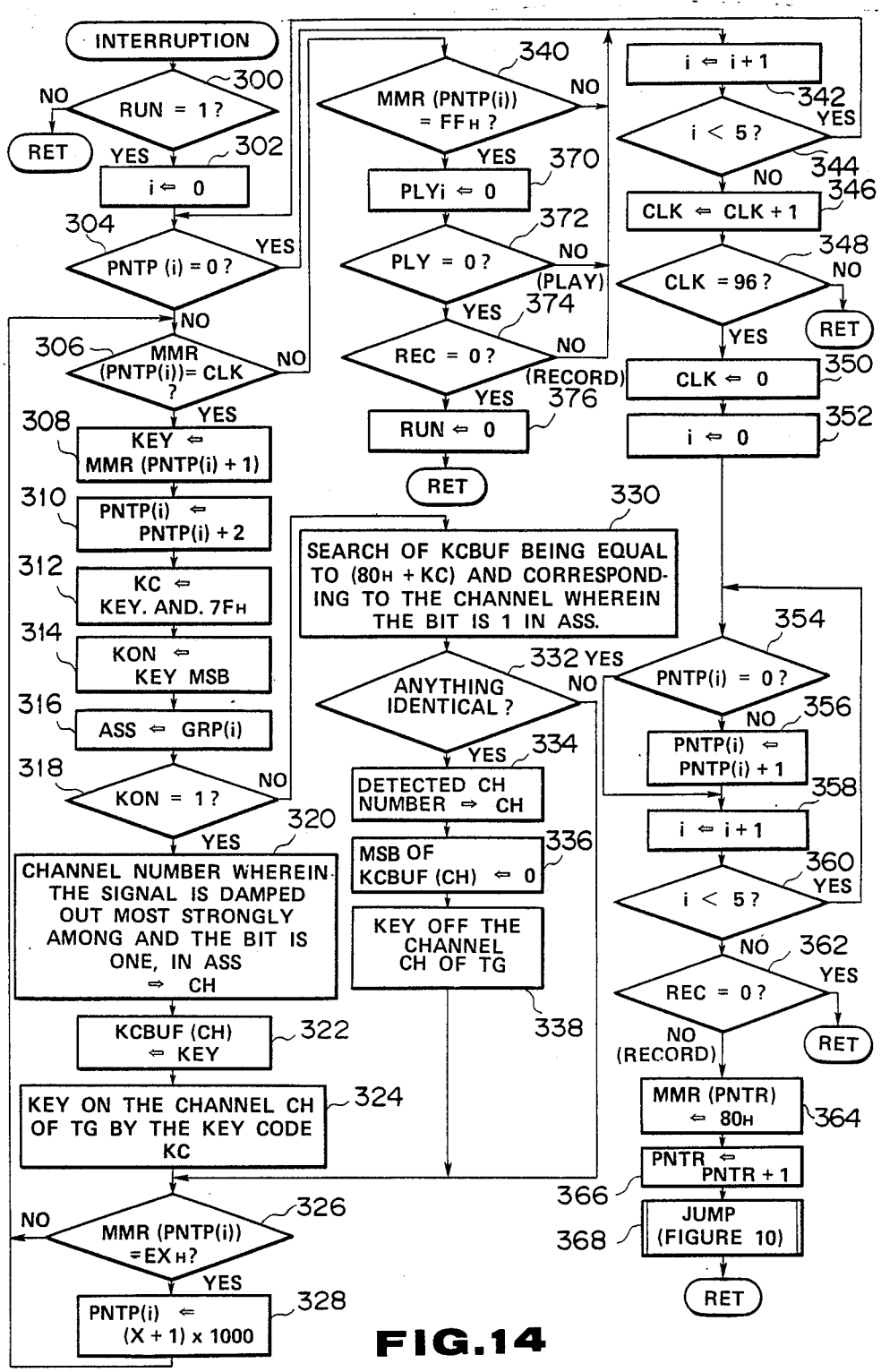
FIG. 14 illustrates a flow chart of the clock interruption routine.

Clock Interrupt Routine (FIG. 14)

FIG. 14 illustrates the clock interrupt routine. This routine is initiated by each clock pulse of the tempo clock signal (TCL).

Whether RUN is 1 is decided in Step 300. Return to the routine shown in FIG. 7 is directed if the decision is no (N). Execution of Step 302 is directed if the decision is yes (Y).

After the control variable i is set to 0 in Step 302, Step 304 is executed to decide whether the i'th pointer PNTP(i) is 0 (in the play mode for a jump or in the record mode). If the decision is no (N), the execution of Step 306 is directed to refer to the automatic playing memory 22 in terms of PNTP(i).

Step 306 is designed to decide whether the data in MMR(PNTP(i)) is equivalent to that for the timing indicated by CLK (whether is the timing for tone generation or tone stopping). If the decision is yes (Y), Step 308 is executed to put the data in MMR(PNTP(i)+1) into KEY. Execution of Step 312 is directed after the value of PNTP(i) is increased by two in Step 310.

In Step 312, an AND operation is executed between the data in KEY and that in 7FH (01111111B) in order to extract the key code form KEY. Then, the key code is put into KC and the execution of Step 314 is directed.

The MSB in KEY (0 or 1) is put into KON in Step 314, and Step 316 is then executed so that the data in the i'th register GRP(i) is put into ASS. Thus, if GRP(0) is 00011, for example, channels 0 and 1 are now assignable.

Next, Step 318 is executed to decide whether KON is 1 (key-on timing). Execution of Step 320 is directed if the decision is yes (Y). In Step 320, the number of the channel whose tone volume decrement is the largest among the channels corresponding to the bits with 1 is ASS is put into CH. Then, the execution of Step 322 is directed.

In Step 322, the key code in KEY is put into the register KCBUF(CH) which corresponds to the channel number of CH. Step 324 is then executed so that the TG's 26 channel which corresponds to CH is subjected to key-on operation according to the key code in KC to generate a musical tone signal corresponding to that key code. Then, the execution of Step 326 is directed.

Step 326 is designed to decide whether the data in MMR(PNTP(i)) is identical with EXH (jump mark). Return to Step 306 is directed if the decision is no (N). Execution of Step 328 is directed if the decision in Step 326 is yes (Y).

In Step 328, the top address of the jump destination calculated according by the formula $(X+1)\times 1000$ is put into PNTP(i). Here, X denotes the four least significant bits (the number of the memory block used as the jump destination) in MMR(PNTP(i) used in Step 326. In the case where PNTP(0), PNTP(1) and X are 1, 0 and 1, respectively, for example, 2000 is set in PNTP(0) to permits a jump to the memory block $B_1$. Thus, after this point, PNTP(0) will be used to read out music playing information from the memory block $B_1$ while PNTP(1) will not be used. Return to Step 306 is directed after the execution of Step 328.

After the return to Step 306, the same operations as above are executed again. The same number of tones as the number of bits with 1 in GRP(i) (two tones in the above case where GRP(0) is 00011) can be generated simultaneously according to the timing of CLK.

If the decision in Step 318 is no (N), on the other hand, it indicates that KON represents a key-on timing, and the execution of Step 330 is directed. In Step 330, the KCBUFs associated with the channels corresponding to the bits with 1 in ASS are examined to search for those KCBUFs equivalent to (80H+KC) (channels to which data equivalent to the key code in KC have already been assigned).

Where equivalent one's are found, execution of Step 334 is directed. In Step 334, the number of the channel to which the key code is found to have been assigned is put into CH. Execution of Step 226 is then directed.

The MSB in KCBUF(CH) is set to 0 in Step 336. As a result, the MSB in the key code information in KCBUF(CH) is shifted from 0 to 1. Then, Step 338 is executed so that the TG's 26) channel which corresponds to CH is subjected to key-off operation to stop the musical tone signal being generated.

After the completion of the execution of Step 338 or where the decision in Step 332 is no (N), execution of Step 326 is directed and the operations in and after Step 326 are executed again in the same way as above.

The above operations are designed for the case where the decision in Step 306 is yes (Y). Execution of Step 340 is directed if the decision in Step 306 is no (N).

Whether the data in MMR(PNTP(i) is FFH (finish information) is decided in Step 340. Execution of Step 342 is directed if the decision is no (N). Execution of Step 342 is also directed if the decision in Step 304 is yes (Y).

The value of i is increased by one in Step 342. Step 344 is then executed to decide whether i is smaller than 5. If the decision is yes (Y), return to Step 304 is directed and the operations in and after Step 304 is executed repeatedly in the same way as above until i becomes 5. Thus, if PNTP(0)-PNTP(4) are all 1, for example, five-part automatic playing can be performed according to the music playing information on parts 0–4 stored in memory blocks $B_0$–$B_4$, respectively. If, in the above example, it is decided in Step 306 that the key-on timing data in the blocks $B_0$–$B_4$ are all equivalent to the timing data in CLK, five tones are generated simultaneously according to that timing.

When i becomes 5, the decision of no (N) is given in Step 344 and the execution of Step 346 is directed. The value of CLK is increased by one in Step 348, and the execution of Step 348 is then directed.

Whether CLK is 96 (end of the bar) is decided in Step 348. Return to the routine shown in FIG. 7 is directed if the decision is no (N).

If the decision in Step 348 is yes (Y), Step 350 is executed to set CLK to 0. Then, i is set to 0 in Step 352 and the execution of Step 352 is directed.

Whether PNTP(i) is 0 is decided in Step 352. If the decision is no (N), Step 356 is executed to increase the value of PNTP(i) by one. This operation is designed to get over the bar lines during playing in the play mode.

After the completion of the execution of Step 356 or where the decision in Step 354 is yes (Y), the value of i is increased by one in Step 358 and whether i is smaller than 5 is decided in Step 360. If the decision is yes, return to Step 345 is directed and the operations in and after Step 345 are executed repeatedly in the same way as above until i becomes 5.

When i becomes 5, the decision of no (N) is given in Step 360, and execution of 362 is directed. Whether REC is 0 (play mode) is decided in Step 362. Return to the routine shown in FIG. 7 is directed if the decision is yes (Y).

If the decision is no (N) in Step 362, it indicates that REC represents the play mode, and execution of Step 364 is directed. In Step 364, 80H (bar line information) is written in MMR(PNTR). Then, the value of PNTR is increased by one in Step 366, and execution of Step 368 is directed.

In Step 368, the jump subroutine previously described with reference to FIG. 10 is executed, and return to the routine illustrated in FIG. 7 is then directed.

The operations described above permit automatic playing or recording of the tones played, according to CLK for each memory block. In this case, the several memory blocks which are combined (into a group) are treated as one continuous memory block.

If the decision in Step 340 is yes (Y), it indicates the end of the automatic playing of one part. Step 370 is then executed to put 0 into $PLY_i$, the i'th bit in PLY, and execution of Step 372 is directed.

Whether PLY is 0 (without a part in the play mode) is decided in Step 372. If the decision is no (N), Step 342 is executed to continue the automatic playing of another part. Execution of Step 374 is directed if the decision in Step 372 is yes (Y).

Whether REC is 0 (without a part in the record mode) is decided in Step 374. If the decision is no (N), Step 342 is executed to continue the automatic playing of parts in the record mode. If the decision in Step 374 is yes (Y), it indicates that no parts are in the play or record mode, and return to the routine shown in FIG. 7 is directed after setting RUN to 0 in Step 376.

The present invention is not limited to the above example, but can be modified into various forms. Some examples of modification are described below.

(1) only one keyboard is used in the above example, making it impossible for two parts to be recorded simultaneously during use in the record mode. Such simultaneous recording can be performed by using several keyboards or by diving one keyboard into several portions.

(2) Information on relative timing with respect to the previous event may be used as timing information for the automatic playing memory 22. In such a case, a bar line is recorded only when a time interval equivalent to one bar has passed after the previous event. This permits a reduction in required memory capacity.

(3) The number of memory blocks in the memory 22 and number of tone generating channels in TG 26 used for automatic playing are not limited to those used in the above example.

(4) Designation of the number of channels for recording and designation of parts to be replayed may be controlled by different controls provided separately for each of them.

EXAMPLE OF MODIFICATION

Figure 5:
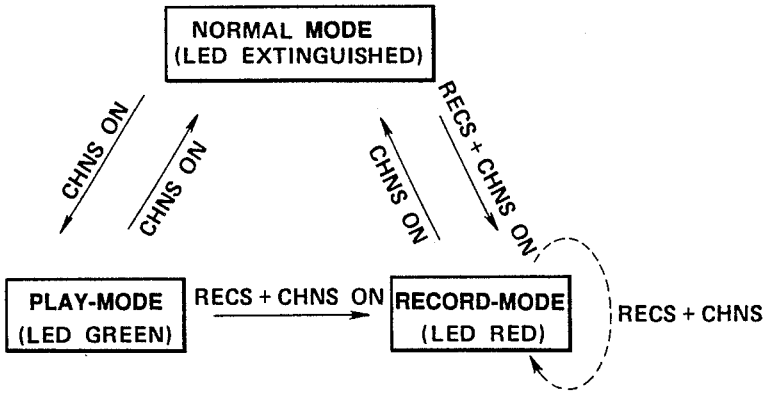
FIG. 5 illustrates a state diagram showing the mode switching actions.

Mode Switching Action (FIG. 5)

The mode switching action is described below with reference to FIG. 5.

Three modes, normal, record and play, are available. In the normal mode, manual playing on the keyboard (12) can be performed, thought the playing cannot be recorded or replayed. In the record mode, information on manually played music is recorded in the automatic playing memory 22. In the play mode, automatic playing is performed based on the information recorded in the memory 22. Manual playing is also possible in this mode.

Mode switching operation on the panel can be performed separately for each channel number/part designation switch (CHNS) when the run flag (RUN) is maintained at 0 (stop) or −1 (standby for synchronized start). The switches (CHNSs) from 0 to 4 can be set to various combinations: only one of the above-mentioned three modes may be selected, or different modes may be selected as required. FIG. 5 illustrates the mode switching action associated with a specific switch (CHNS) and the record mode designation switch (RECS).

When the normal mode is selected, the display device (LED) corresponding to that switch (CHNS) is in the off state. Then, if the CHNS alone is turned on, the play mode is set and the LED emits green light. If both the RECS and CHNS are turned on after selecting the normal mode, the mode is switched to record and the LED emits red light.

The mode is switched to record if both the RECS and CHNS are turned on after selecting the play mode. The mode is switched to normal if only the CHNS is turned after selecting the record mode. In the latter case, the mode is maintained at record if both RECS and CHNS are turned on.

The above description is related with the basic action associated with one switch (CHNS). The following actions from (1) to (3) will occur if this switch (CHNS) is used with other switches (CHNSs) in the same group. A group as referred to in the previous sentence consists of those several switches (CHNSs) which are set to the record mode when RUN is adjusted to 1 by appropriate procedures such as the control of the start/stop switch (SPS).

(1): Suppose that a switch (CHNS) is in the record mode and another switch (CHNS) is shifted from the normal mode to the play mode. If these switches are in the same group, the switch in the record mode is shifted from the record mode to the play mode, resulting in both switches in the group coming into the play mode. Consider, for example, the case where chord playing is recorded with RUN set to 1 after adjusting switches (CHNSs) 2–4 to the record mode. If any of switches (CHNSs) 2–3 are turned on after the recording, the switch turned on is set to the normal mode. If the switch is turned on again, it comes into the play mode and at the same time, the other switches in the same group are also set to the play mode. Thus, although several switches (SHNSs) which correspond to the number of desired channels have to be operated for recording, a desired part for replay can be selected only by operating one of these switches (CHNSs).

(2): Suppose that a switch (CNHS) in the play mode is shifted to the record mode. If there are other switches (CHNSs) in the same group as the former switch, all of them will be shifted to the normal mode. If, as in the above case, all switches 2–4 are set to the record mode followed by readjusting switch 2 to the record mode, then both switches 3 and 4 will be shifted to the normal mode.

(3): Suppose that a switch (CHNS) in the play mode is shifted to the normal mode. If there are other switches (CHNSs) in the same group as the former switch, all of them will be shifted to the normal mode. If, as in the above case, all switches 2–4 are set to the record mode followed by readjusting switch 2 to the normal mode, then both switches 3 and 4 will be shifted to the normal mode.

Figure 6:
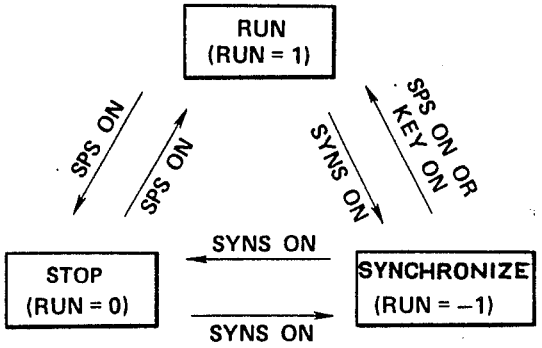
FIG. 6 illustrates a state diagram showing the start/-stop actions.

Start/Stop Action (FIG. 6)

The start/stop action is described below with reference to FIG. 6.

Where RUN has been set to 0 , turning on the start/-stop switch (SPS) will set RUN to 1 to actuate the apparatus (the tempo clock signals (TCLs) begin to be counted according to the clock interrupt routine as illustrated later in FIG. 14). If SPS is switched on again where the RUN has been set to 1 (on state), RUN is reset to 0 to stop the apparatus.

Where RUN has been set to 0 (off state) or where RUN has been set 1 (on state), turning on the synchronized start switch (SYNS) will adjust RUN to −1 (synchronized start standby state). In the synchronized start standby state, the actuation of SPS or the occurrence of a key-on event on the keyboard (12) will adjust RUN to 1 to actuate the apparatus.

Operation in the normal mode is possible where RUN has been set to 0 (off state). Operation in the record mode and/or play mode is possible where RUN has been set to 1 (on state). Where RUN has been set to −1 (synchronized start standby state), actions in the record mode and/or play mode can be started synchronously with a key-on event on the keyboard.

What is claimed is:

1. An automatic music playing apparatus, capable of generating a musical tone to be assigned for at least one of a melody part, chord part, and bass part of a musical piece, comprising:

(a) tone generating means having a plurality of tone generating channels for generating musical tone signals in response to music playing information;

(b) input means for inputting music playing information;

(c) memory means for storing music playing information, said memory means having plural storage areas with each storage area corresponding to a tone generating channel;

(d) means for detecting an amount of data stored in a storage area of said memory means;

(e) channel number designation means for separately designating a desired number of tone generating channels of the tone generating means for each part of the musical piece; and (f) assignment means for assigning music playing information to at least one of the storage areas based on a data amount detected by said means for detecting.

2. An automatic music playing apparatus according to claim 1 wherein the apparatus includes a mode designation means to designate selectively a record mode and a play mode.

3. An automatic music playing apparatus according to claim 2 in which the channel number designation means is actuated when the record mode is designated by the mode designation means, wherein the desired number of tone generating channels of the tone generating means are designated separately for the tones of each part of the musical piece to be recorded.

4. An automatic music playing apparatus according to claim 3 wherein the apparatus includes a channel number recording means in which the number of channels designated by the channel number designation means is recorded separately for each part of the musical piece.

5. An automatic music playing apparatus according to claim 4 wherein the apparatus includes a memory writing means which is actuated when the record mode is designated by the mode designation means and by which the music playing information received from the input means is written separately for each part of the musical piece in the memory means.

6. An automatic music playing apparatus according to claim 5 wherein the apparatus includes a part designation means actuated when the play mode is designated by the mode designation means and by which the part of the musical piece to be played is designated.

7. An automatic music playing apparatus according to claim 6 wherein the apparatus includes a memory reading means by which music playing information associated with the part designated by the part designation means is read from the memory means.

8. An automatic music playing apparatus according to claim 7 in which the music playing information read from the memory means is assigned by the assignment means to at least one of the storage areas in accordance with the channel number recorded by the channel number recording means in association with the part designated by the part designation means.

9. An automatic music playing apparatus according to claim 1, wherein when said means for detecting detects that a current storage area is filled with data, said assignment means assigns music playing information to a next storage area.

10. An automatic music playing apparatus, capable of generating a musical tone to be assigned for at least one of a melody part, chord part, and bass part of a musical piece, comprising:

(a) musical tone generating means having a plurality of tone generating channels, each of the musical tone generating channels storing musical tone control information, the musical tone generating means generating musical tone signals in response to the musical tone control information stored in the tone generating channels;

(b) input means for inputting music playing information;

(c) mode designation means for designating one of a record mode and a play mode;

(d) first memory means for storing music playing information, the first memory means having plural storage areas with each storage area corresponding to a tone generating channel;

(e) channel number designation means for separately designating a desired number of the musical tone generating channels for each part of the musical piece when the record mode is selected;

(f) second memory means for storing a number of channels designated by said channel number designation means for a respective part of the musical piece;

(g) writing means for writing music playing information in the storage areas of the first memory means;

(h) part designation means for designating the part of the musical piece to be played when the play mode is selected;

(i) reading means for reading the music playing information according to the assignment of the part designation means;

(j) means for detecting an amount of data stored in a storage area of the first memory means; and (k) assignment means for assigning music playing information read out of the first memory means to at least one of the storage areas based on a data amount detected by said means for detecting.

11. An automatic performance apparatus according to claim 10, wherein when said means for detecting detects that a current storage area is filled with data, said assignment means assigns music playing information to a next storage area.

* * * * *